US009054451B2

(12) United States Patent
Tateishi et al.

(10) Patent No.: US 9,054,451 B2
(45) Date of Patent: Jun. 9, 2015

(54) ELECTRICAL CONNECTOR

(71) Applicant: DAI-ICHI SEIKO CO., LTD., Kyoto-shi (JP)

(72) Inventors: Jin Tateishi, Fukuoka (JP); Masataka Muro, Fukuoka (JP)

(73) Assignee: DAI-ICHI SEIKO CO., LTD., Kyoto-shi (JP)

( * ) Notice: Subject to any disclaimer, the term of this patent is extended or adjusted under 35 U.S.C. 154(b) by 81 days.

(21) Appl. No.: 13/864,406

(22) Filed: Apr. 17, 2013

(65) Prior Publication Data

US 2013/0309891 A1 Nov. 21, 2013

(30) Foreign Application Priority Data

May 16, 2012 (JP) ..... 2012-112811

(51) Int. Cl.
*H01R 12/72* (2011.01)
*H01R 13/62* (2006.01)
*H01R 12/77* (2011.01)

(52) U.S. Cl.
CPC ..... *H01R 13/62* (2013.01); *H01R 12/774* (2013.01); *H01R 12/721* (2013.01)

(58) Field of Classification Search
CPC ..... H01R 12/79
USPC ..... 439/492, 495, 260, 267
See application file for complete search history.

(56) References Cited

U.S. PATENT DOCUMENTS 6,790,073 B2 * 9/2004 Wu ..... 439/495
7,048,573 B2 * 5/2006 Masaki et al. ..... 439/492
7,399,193 B1 * 7/2008 Ho et al. ..... 439/260
7,648,377 B2 * 1/2010 Naito et al. ..... 439/188
7,661,972 B2 * 2/2010 Okamura et al. ..... 439/260
7,850,473 B1 * 12/2010 Ozeki ..... 439/260
7,892,002 B2 * 2/2011 Shen et al. ..... 439/260
7,997,924 B2 * 8/2011 Yu ..... 439/495
8,002,567 B2 * 8/2011 Hara ..... 439/329
8,133,067 B2 * 3/2012 Tsai et al. ..... 439/260

(Continued)

FOREIGN PATENT DOCUMENTS

JP 2005-78908 3/2005
JP 2006-32155 A 2/2006

(Continued)

*Primary Examiner* — Ross Gushi
(74) *Attorney, Agent, or Firm* — Oblon, McClelland, Maier & Neustadt, L.L.P.

(57) ABSTRACT

An engagement amount of a latch lock part with respect to a signal transmission medium is sufficiently and constantly ensured by a simple configuration. A reference abutting surface having a stepped shape projecting toward an upper surface of the signal transmission medium compared with other part of an inner wall surface of a medium insertion path is formed at part of the inner wall surface of the medium insertion path facing the upper surface of the signal transmission medium, the upper surface of the signal transmission medium is caused to abut at least the reference abutting surface of the medium insertion path, and the position of the upper surface of the signal transmission medium is determined in the thickness direction while using the reference abutting surface as a reference. As a result, the engagement amount and the canceling amount of a latch lock part can be constantly maintained regardless of variations in the thickness of the signal transmission medium, the force of retaining the signal transmission medium is stabilized, and this electrical connector can be downsized.

6 Claims, 15 Drawing Sheets

(56) References Cited

U.S. PATENT DOCUMENTS

| | | | | |
|---|---|---|---|---|
| 8,202,108 | B2 * | 6/2012 | Shen | 439/329 |
| 8,342,869 | B2 * | 1/2013 | Okamura | 439/260 |
| 8,398,417 | B2 * | 3/2013 | Ozeki | 439/260 |
| 8,814,588 | B2 * | 8/2014 | Wang et al. | 439/358 |
| 2003/0096530 | A1 * | 5/2003 | Ma et al. | 439/495 |
| 2003/0139079 | A1 * | 7/2003 | Longueville et al. | 439/260 |
| 2003/0236024 | A1 * | 12/2003 | Wu | 439/495 |
| 2004/0248460 | A1 * | 12/2004 | Masaki et al. | 439/492 |
| 2006/0160390 | A1 * | 7/2006 | Miura et al. | 439/260 |
| 2006/0234542 | A1 * | 10/2006 | Ko | 439/495 |
| 2007/0093122 | A1 * | 4/2007 | Kudo et al. | 439/495 |
| 2007/0141896 | A1 * | 6/2007 | Huang et al. | 439/495 |
| 2007/0202737 | A1 * | 8/2007 | Wei et al. | 439/495 |
| 2009/0264009 | A1 * | 10/2009 | Wang et al. | 439/495 |
| 2010/0130045 | A1 * | 5/2010 | Higuchi | 439/260 |
| 2010/0261375 | A1 * | 10/2010 | Wang et al. | 439/492 |
| 2010/0304591 | A1 * | 12/2010 | Ishishita et al. | 439/260 |
| 2011/0021065 | A1 * | 1/2011 | Yu | 439/495 |
| 2012/0083150 | A1 * | 4/2012 | Ozeki | 439/345 |
| 2012/0220171 | A1 * | 8/2012 | Shimada et al. | 439/660 |
| 2013/0023138 | A1 * | 1/2013 | Sasaki et al. | 439/260 |
| 2013/0309887 | A1 * | 11/2013 | Honda | 439/260 |
| 2013/0309891 | A1 * | 11/2013 | Tateishi et al. | 439/310 |

FOREIGN PATENT DOCUMENTS

| | | | |
|---|---|---|---|
| JP | 2010-238512 | A | 10/2010 |
| JP | 2012-22848 | A | 2/2012 |

* cited by examiner

ELECTRICAL CONNECTOR

BACKGROUND OF THE INVENTION

1. Field of the Invention

The present invention relates to an electrical connector configured so that a signal transmission medium inserted in a medium insertion path is engaged with and retained by latch lock parts.

2. Description of Related Art

Generally, in various electric devices, etc., various electrical connectors are widely used as means for electrically connecting various signal transmission media such as flexible printed circuits (FPC) and flexible flat cables (FFC). For example, in an electrical connector used when mounted on a printed wiring board like below-described Japanese Patent Application Laid-Open No. 2005-078908, a signal transmission medium consisting of, for example, a FPC or FFC is inserted from a front-end-side opening of a medium insertion path formed by inner wall surfaces of an insulating housing (insulator) to the interior thereof, and an actuator (turning operation means) is then turned so as to be pushed down toward a connection working position in a connector front side or rear side by the operating force of an operator. As a result, latch lock parts disposed so as to be opposed to engagement position determining parts provided at terminal parts of the signal transmission medium are moved so as to be dropped and achieve a latched state, and the engagement force of the latch lock parts with respect to the engagement position determining parts of the signal transmission medium in this process is configured to retain the terminal parts of the signal transmission medium in an approximately immobile state.

On the other hand, in an electrical connector provided with a so-called one-action auto-lock mechanism, latch loc parts are elastically displaced so as to be placed over a signal transmission medium inserted in an insulating housing, and the latch lock parts are configured to then drop in engagement position determining parts of the signal transmission medium to carry out engagement. When an electrical connector having such a one-action auto-lock mechanism is used, the signal transmission medium is retained in an approximately immobile state only by the insertion of inserting the signal transmission medium to a predetermined position in the electrical connector, wherein working efficiency is improved.

In this manner, general electrical connectors widely employ the configuration in which a signal transmission medium is retained by achieving a latched state by moving the latch lock parts so that the parts are engaged with the engagement position determining parts of the signal transmission medium from the state in which the latch lock parts are facing a first-side surface of the signal transmission medium inserted in the medium insertion path. However, the thickness of the signal transmission media to be inserted in the electrical connector are varied, and there is a problem that the latching amount, in other words, the engagement amount of the latch lock parts are varied depending on the variation amounts of the signal transmission media.

More specifically, even when the variation amounts in the thickness of the signal transmission media are within set dimensional tolerance, the latch amounts of the latch lock parts with respect to the engagement position determining parts are small for the signal transmission media having thin sizes; therefore, the retention force of the signal transmission media may be reduced, and the signal transmission media may fall off from the electrical connector. On the other hand, in a case in which a signal transmission medium having a thick size is inserted in the electrical connector, the latch amounts of the latch lock parts with respect to the engagement position determining parts of the signal transmission medium are large, and sufficient retention force of the signal transmission medium is obtained; however, when the latch lock parts are to be detached from the signal transmission medium by carrying out an unlock operation, the movement distances (stroke distances) required for detachment of the latch lock parts have to be largely ensured to correspond to the thickness of the signal transmission medium, and the size of the entirety of the electrical connector tends to be increased by the increased amount of the thickness.

Moreover, in order to enable the signal transmission medium to be smoothly inserted to the electrical connector, problems, for example, that the engagement position determining parts provided in the signal transmission medium are caught by intermediate parts of the medium insertion path have to be eliminated; and, in order to do that, guide wall parts which guide both-side edges of the signal transmission medium have been conventionally provided in the insulating housing. Since edge parts of the signal transmission medium contact or collide with the guide wall parts of the insulating housing, the thicknesses of the guide wall parts are increased to impart them predetermined strength so that deformation or damage are not caused in the guide wall parts by the collision force thereof. Therefore, the conventional electrical connectors have an inclination that the sizes of the electrical connectors are increased by the amounts of the necessity to increase the thickness of the guide wall parts.

We disclose the prior art that we are aware of to be materials for the examination of the application as follows.

[Unexamined Publication Gazette 1]

JP 2005-078908 A (Patent Application Laid-Open)

BRIEF SUMMARY OF THE INVENTION

Therefore, it is an object of the present invention to provide an electrical connector enabled by a simple configuration to sufficiently ensure an engagement amount of a latch lock part with respect to a signal transmission medium regardless of variations in the thickness of the signal transmission medium and to downsize the entirety thereof.

In order to achieve the above described object, the present invention employs a configuration of an electrical connector configured so that a signal transmission medium is inserted to or removed from interior of a medium insertion path formed so as to be surrounded by an inner wall surface of an insulating housing and configured so that, when a latch lock part(s) is moved to an engagement position with respect to an engagement position determining part of the signal transmission medium inserted in the medium insertion path, the latch lock part retains the signal transmission medium; wherein part of the inner wall surface of the medium insertion path facing a first-side surface of the signal transmission medium is provided with a reference abutting surface that abuts the first-side surface of the signal transmission medium, and the reference abutting surface is formed so as to form a stepped shape projecting toward the first-side surface of the signal transmission medium compared with other part of the inner wall surface of the medium insertion path facing the first-side surface of the signal transmission medium and is formed so as to have the step in the thickness direction of the signal transmission medium.

The latch lock parts of this case can be disposed in connector longitudinal-direction both-side regions of the signal transmission medium, and the reference abutting surface can be disposed at a position adjacent to the latch lock part in the connector longitudinal direction.

The latch lock part can be in an arrangement relation that the latch lock part is placed over an upper-side surface of the signal transmission medium and elastically displaced, the reference abutting surface can be formed at part of the upper-side inner wall surface of the medium insertion path facing the upper-side surface of the signal transmission medium, and the reference abutting surface can be positioned in a lower side with respect to the other part of upper-side inner wall surface so as to form the step.

According to the present invention having such a configuration, when the signal transmission medium is inserted to the medium insertion path, since the reference abutting surface forming part of the inner wall surface of the medium insertion path is in a positional relation closer to the first-side surface of the signal transmission medium than the other part, the first-side surface of the signal transmission medium is caused to be in a state abutting at least the reference abutting surface of the medium insertion path, and the first-side surface of the signal transmission path is caused to be in a state that the position of the first-side surface is determined in the thickness direction while using the reference abutting surface as a reference. On the other hand, the latch lock part is moved from the first-side surface side of the signal transmission medium toward the engagement position; therefore, when the position of the first-side surface of the signal transmission medium is determined by the reference abutting surface, the engagement amount of the latch lock part with respect to the signal transmission medium can be constantly maintained regardless of variations in the thickness of the signal transmission medium, the retention force of the signal transmission medium can be stabilized, the movement distance of the latch lock part necessary for canceling the engaged state of the latch lock part can become constant, and the electrical connector can be downsized without taking variations in the thickness of the signal transmission medium into consideration.

Moreover, the latch lock part in the present invention is desired to be provided with a stopper piece that abuts part of the insulating housing when engaged with the engagement position determining part of the signal transmission medium.

According to the present invention having such a configuration, the movement position of the latch lock part is regulated to a constant position by the stopper piece. Therefore, the engagement amount of the latch lock part with respect to the signal transmission medium is further stably obtained, and the projecting amount of the latch lock part distal end in a standby state is also stably obtained.

Furthermore, it is desired that the latch lock part in the present invention be integrally continued to a pressing member opposed to the latch lock part in a thickness direction of the signal transmission medium, and the signal transmission medium be configured to be biased toward the latch lock part side by the pressing member. Moreover, it is desired that the pressing member have a cantilever-like plate spring piece connected to a ground electrically-conductive path of the signal transmission medium.

According to the present invention having such a configuration, the signal transmission medium inserted in the medium insertion path is pressed to the latch lock part side by the plate spring piece of the pressing member. Therefore, the signal transmission medium more reliably abuts the reference abutting surface.

Furthermore, the present invention employs a configuration of an electrical connector configured so that a signal transmission medium comes to be inserted to or removed from interior of a medium insertion path formed so as to be surrounded by an inner wall surface of an insulating housing, and configured so that, when a latch lock part(s) is moved to an engagement position with respect to an engagement position determining part of the signal transmission medium inserted in the medium insertion path, the latch lock part retains the signal transmission medium; wherein the insulating housing is provided with guide side wall plates to be brought into contact with width-direction both-side surfaces of the signal transmission medium inserted in the medium insertion path, and a supporting piece part that abuts each of the guide side wall plates of the insulating housing from a width-direction outer side of the signal transmission medium is integrally continued to a latch lock part.

According to the present invention having such a configuration, the signal transmission medium inserted in the medium insertion path is smoothly moved along the guide side wall plates of the insulating housing, and the guide side wall plates of the insulating housing are reinforced by the supporting pieces continued to the latch lock part. Therefore, the thickness of the guide side wall plates can be reduced, and the electrical connector is correspondingly downsized.

As described above, in the electrical connector according to the present invention, the reference abutting surface that abuts the first-side surface of the signal transmission medium is formed at the part of the inner wall surface of the medium insertion path, which faces the first-side surface of the signal transmission medium, so as to form the stepped shape projecting toward the first-side surface of the signal transmission medium compared with the other part of the inner wall surface of the medium insertion path; the reference abutting surface forming part of the inner wall surface of the medium insertion path has a positional relation closer to the first-side surface of the signal transmission medium than the other part; the first-side surface of the signal transmission medium is caused to be in a state abutting at least the reference abutting surface of the medium insertion path; and the position of the first-side surface of the signal transmission medium is determined in the thickness direction while using the reference abutting surface as a reference. As a result, the engagement amount of the latch lock part with respect to the signal transmission medium is constantly maintained regardless of variations in the thickness of the signal transmission medium, the retention force of the signal transmission medium is stabilized, and the movement distance of the latch lock part necessary for canceling the engaged state of the latch lock part is caused to be constant, thereby enabling downsizing of the electrical connector. Therefore, with a simple configuration, the engagement amount of the latch lock part with respect to the signal transmission medium can be sufficiently ensured regardless of variations in the thickness of the signal transmission medium, the entirety thereof can be downsized, and reliability of the electrical connector can be significantly improved at low cost.

DETAILED DESCRIPTION OF THE INVENTION

Hereinafter, an embodiment in which the present invention is applied to an electrical connector, which is to be mounted and used on a printed wiring board in order to establish connection of a signal transmission medium consisting of, for example, a flexible printed circuit (FPC) or a flexible flat cable (FFC), will be explained in detail based on drawings.

[About Overall Configuration of Electrical Connector]

Figure 6:
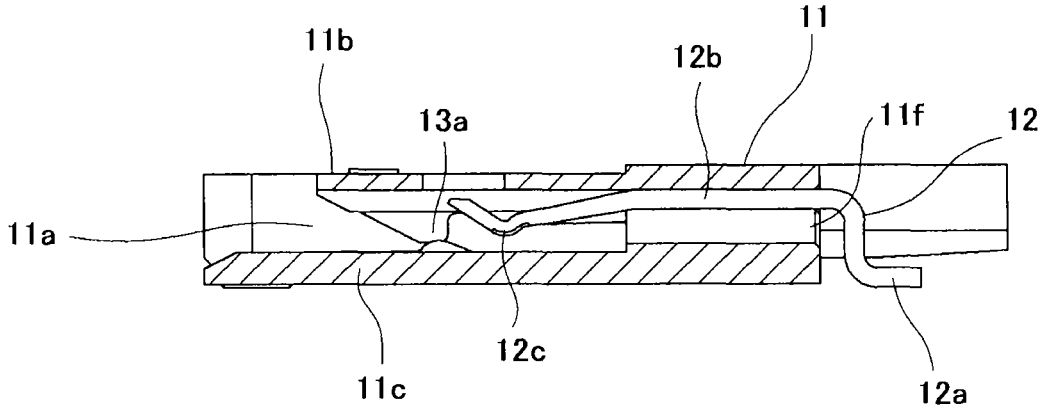
FIG. 6 is an explanatory transverse cross-sectional view along a line A-A in FIG. 3.
Figure 7:
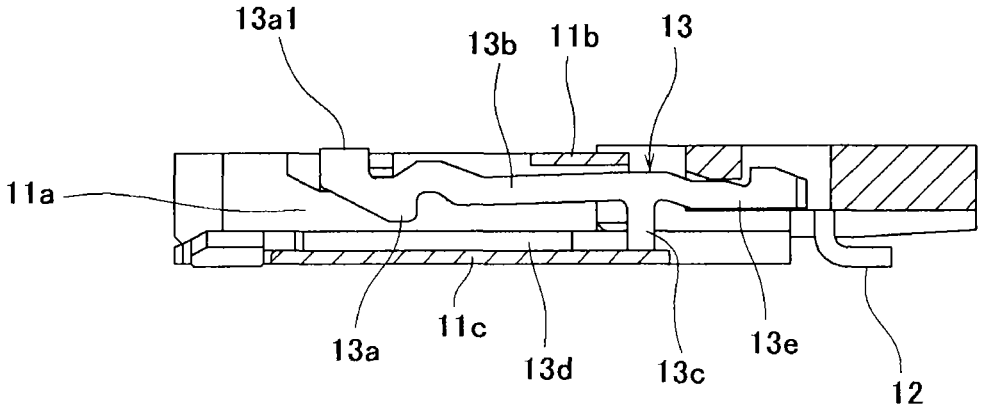
FIG. 7 is an explanatory transverse cross-sectional view along a line B-B in FIG. 3.
Figure 8:
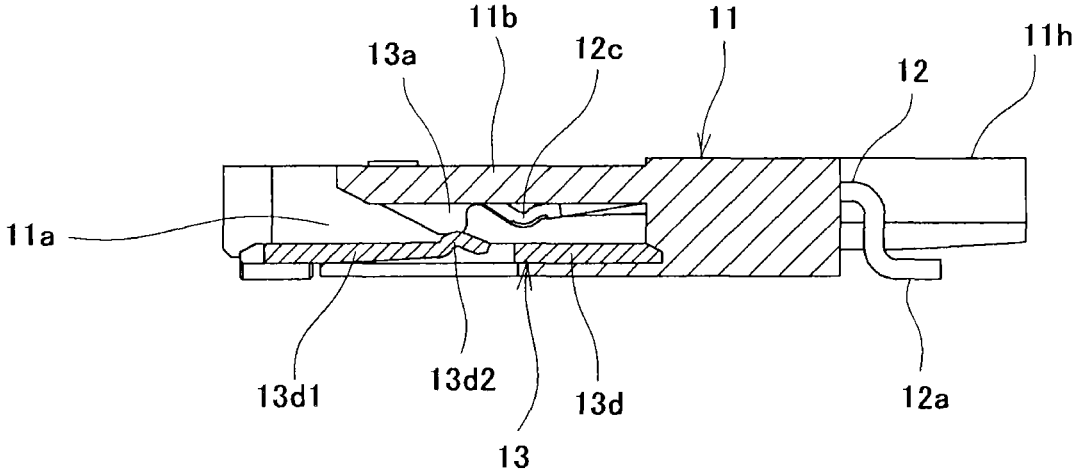
FIG. 8 is an explanatory transverse cross-sectional view along a line C-C in FIG. 3.
Figure 9:
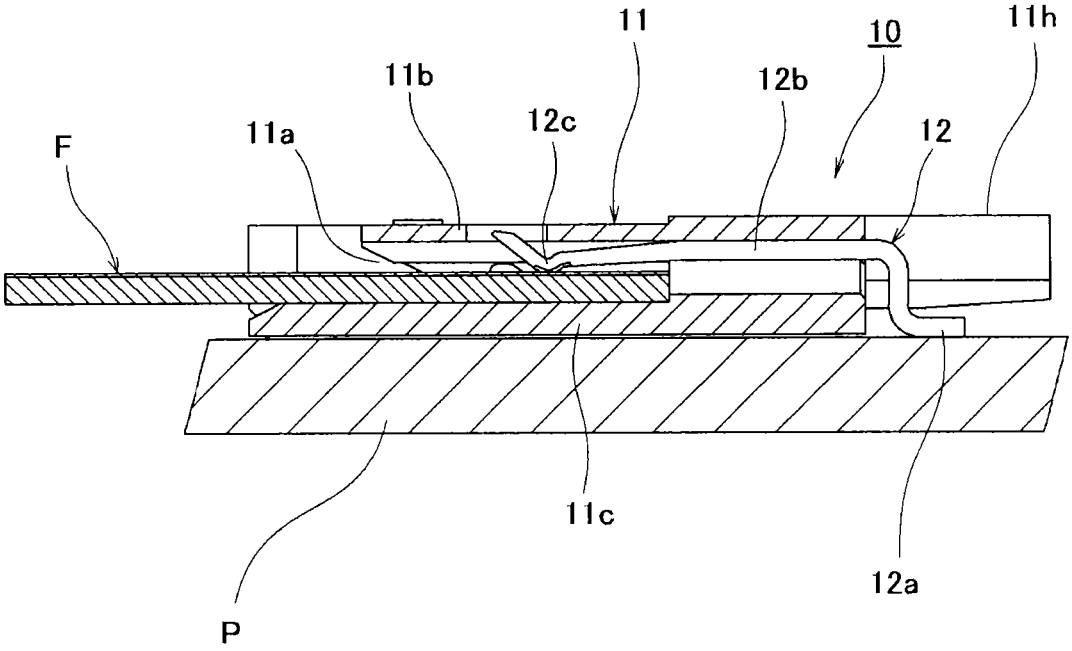
FIG. 9 is an explanatory transverse cross-sectional view corresponding to FIG. 6 showing the state in which the signal transmission medium (FPC) has been inserted to complete insertion of the signal transmission medium with respect to the electrical connector.

The electrical connector 10 according to the embodiment of the present invention shown in FIG. 1 to FIG. 18 consists of an electrical connector provided with a one-action auto-lock mechanism of a so-called NON-ZIF type, wherein, when a terminal part of the above described signal transmission medium (for example, FPC or FFC) F is inserted so as to be inserted to a predetermined position in an insulating housing 11 through a medium insertion opening 11*a* provided at a front edge part (left edge part in FIG. 6) of the insulating housing 11, the signal transmission medium F is configured to be automatically locked.

[About Insulating Housing]

The insulating housing 11 of this case is formed of a hollow-frame-like insulating member, which is extended to be narrow and long. The longitudinal width direction of the insulating housing 11 will be hereinafter referred to as "connector longitudinal direction", and the direction in which the terminal part of the signal transmission medium (for example, FPC or FFC) F is inserted so as to be inserted therein or removed so as to be detached therefrom will be referred to as "connector front-back direction". Furthermore, the direction orthogonal to both of the "connector longitudinal direction" and the "connector front-back direction" will be referred to as "connector top-bottom direction".

A front edge part (left edge part in FIG. 6) of the insulating housing 11 is provided with a medium insertion opening 11*a*, into which the terminal part of the signal transmission medium F consisting of, for example, a flexible printed circuit (FPC) or a flexible flat cable (FFC) as described above is to be inserted, so that the medium insertion opening forms a narrow long shape along the connector longitudinal direction. The medium insertion opening 11*a* is extended toward the connector rear side (the right side in FIG. 6) so as to form a medium insertion path. The medium insertion path consists of a space part formed so as to be surrounded by inner wall surfaces of the insulating housing 11, and the upper and lower inner wall surfaces of the medium insertion path are formed of a ceiling wall plate 11*b* and a bottom-surface wall plate 11*c* of the insulating housing 11.

The connector-longitudinal-direction both-side inner wall surfaces of the medium insertion path are formed by guide side wall plates 11*d*, 11*d* of the insulating housing 11. The guide side wall plates 11*d*, 11*d* are in an arrangement relation that they are brought into contact with board-width-direction both-side end faces of the signal transmission medium (for example, FPC or FFC) F inserted from the medium insertion opening 11*a*, and the both-side end faces of the signal transmission medium F are configured to be smoothly moved while sliding along the guide side wall plates 11*d*, 11*d*. Each of the guide side wall plates 11*d*, 11*d* is formed of a plate-like member, which is comparatively thin in the connector longitudinal direction; and, adjacent to each connector-longitudinal-direction outer-side part with respect to the guide side wall plate 11*d*, a supporting piece 13*d*3 of a later-described lock member 13 is disposed so as to form a reinforcing member of the guide side wall plate 11*d*.

Figure 16:
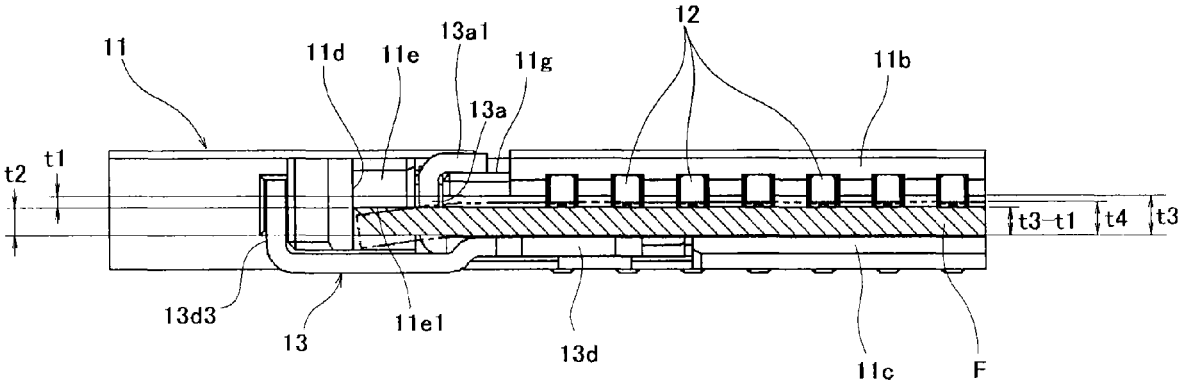
FIG. 16 is a partial enlarged front view enlarging and showing a D part in FIG. 3, which is a first end part in a connector longitudinal direction of the electrical connector shown in FIG. 1 to FIG. 13.
Figure 17:
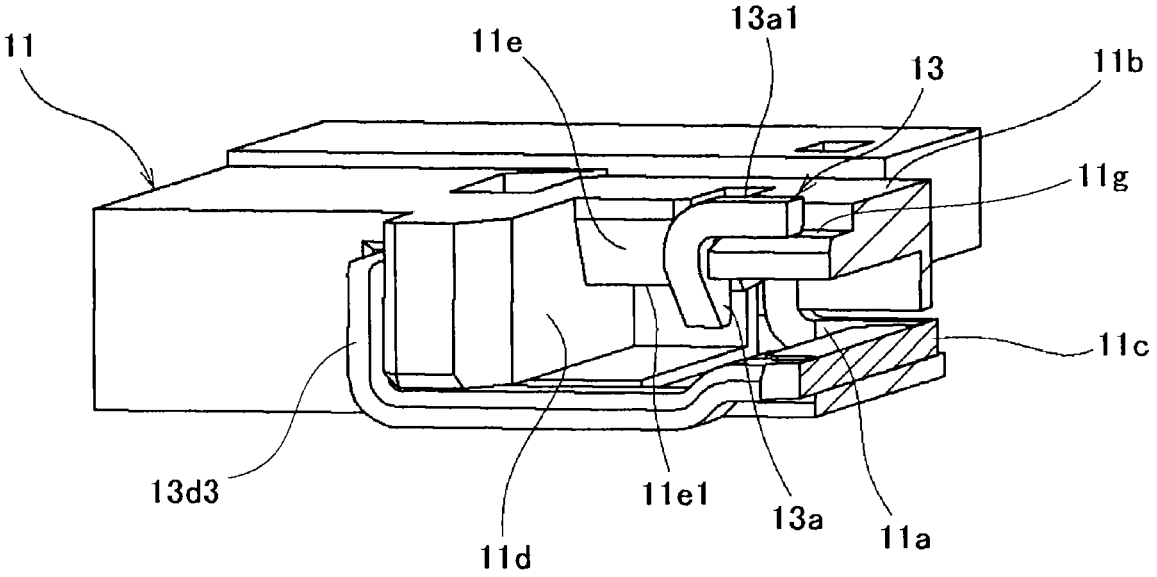
FIG. 17 is a partial enlarged external perspective view enlarging and showing the first end part in the connector longitudinal direction of the electrical connector shown in FIG. 1 to FIG. 13.
Figure 18:
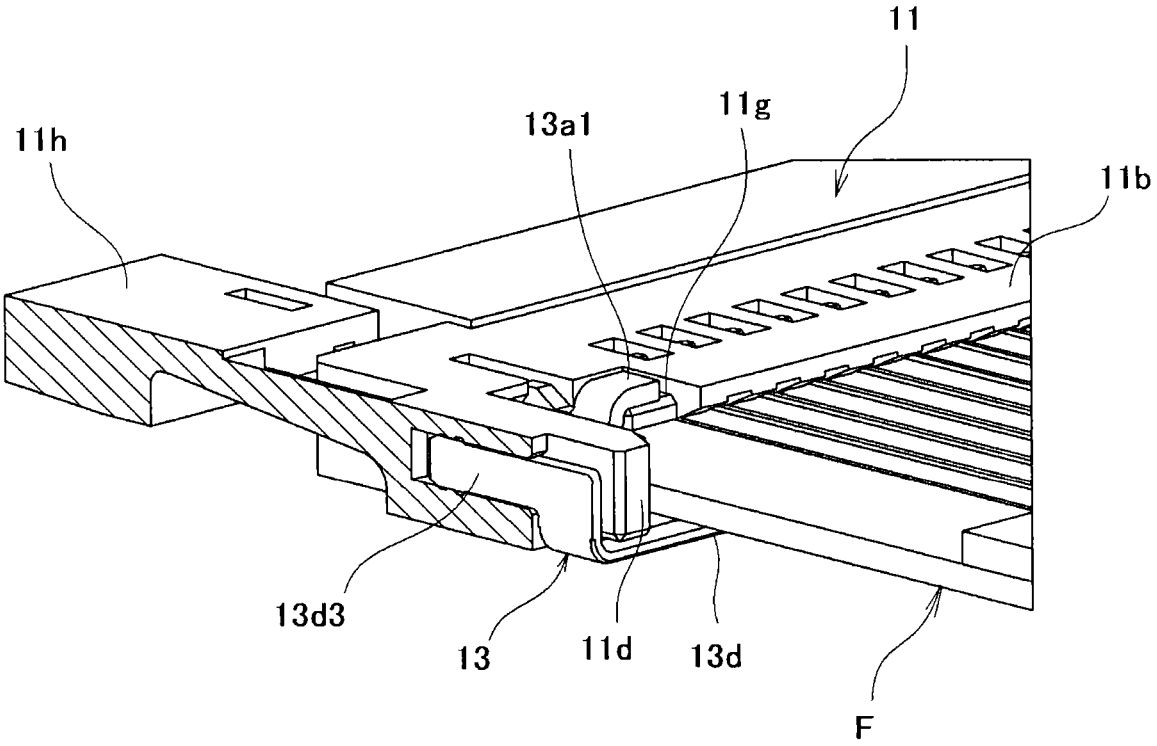
FIG. 18 is an explanatory perspective view showing a transverse cross section along a line F-F in FIG. 1 in an insertion completed state of the signal transmission medium (FPC).

In this manner, upon insertion of the signal transmission medium (for example, FPC or FFC) F into the medium insertion path of the insulating housing 11, a first-side surface (upper surface) of the signal transmission medium F is disposed so as to face the ceiling wall plate 11*b* of the insulating housing 11 from the lower side, a second-side surface (lower surface) of the signal transmission medium F faces the bottom-surface wall plate 11*c* of the insulating housing 11 from the upper side, and the board-width-direction both-side end faces of the signal transmission medium F is moved along both of the guide side wall plates 11*d*, 11*d*. As shown in FIG. 16, in the insulating housing 11 forming the inner wall surfaces of the medium insertion path, edge pressing plates 11*e*, which abut the first-side surface (upper surface) of the signal transmission medium F from the upper side, are formed at the ceiling wall plate 11*b* forming an upper-side inner wall part of the medium insertion path.

The edge pressing plates 11*e* are disposed respectively at connector-longitudinal-direction both-side parts of the ceiling wall plate 11*b* of the insulating housing 11 and are integrally coupled to the inner wall surfaces of both of the guide side wall plates 11*d*, 11*d*. Reference abutting surfaces 11*e*1 are formed on lower surfaces of the edge pressing plates 11*e*, respectively; and the reference abutting surfaces 11*e*1 are in an arrangement relation that they face and abut, from the upper side, the board-width-direction (connector-longitudinal-direction) both-side edge parts of the first-side surface (upper surface) of the signal transmission medium F inserted into the medium insertion path. Corresponding to the edge pressing plates 11*e*, 11*e*, the bottom-surface wall plate 11*c* of the insulating housing 11 is formed so as to be recessed to form downward stepped shapes at connector-longitudinal-direction both-side parts thereof, and the connector-longitudinal-direction both-side regions of the bottom-surface wall plate 11*c* form spatial allowances between there and the lower surface of the signal transmission medium F.

In this manner, the ceiling wall plate 11*b* of the insulating housing 11 has the edge pressing plates 11*e*, 11*e* at the connector-longitudinal-direction both-side parts, the reference abutting surfaces 11*e*1 constituting the lower surfaces of the edge pressing plates 11*e* are formed so as to project somewhat downward compared with other part of the ceiling wall plate 11*b*, in other words, a general inner wall surface (lower surface) owned by the ceiling wall plate 11*b* extended to the connector inner side (connector center side). In this manner, there is an arrangement relation that the positions of the reference abutting surfaces 11*e*1 of the edge pressing plates 11*e* are shifted downward, and the distance (height) t1 of the step formed between there and the general inner wall surface (lower surface) of the ceiling wall plate 11*b* is determined based on a minimum thickness t2 owned by the used signal transmission medium F.

This point will be explained in detail. First, as described above, the medium insertion path of the insulating housing 11 into which the signal transmission medium (for example, FPC or FFC) F is to be inserted is formed as the space part between the ceiling wall plate 11*b*, which includes the edge pressing plates 11*e* of the insulating housing 11, and the bottom-surface wall plate 11*c*; and the connector-longitudinal-direction both end parts of the medium insertion path of this case have an opening height (t3−t1) narrowed in the height direction than the opening height t3 of the connector-longitudinal-direction center part by the amount of the downward step t1 owned by the reference abutting surface 11*e*1 of the edge pressing plate 11*e*. The signal transmission medium F to be inserted in the medium insertion path is inserted to the inner side through the open space having the height (t3−t1) determined by the reference abutting surfaces 11*e*1 and the bottom-surface wall plate 11*c* of the insulating housing 11. Herein, in the present embodiment, the opening height (t3−t1) determined by the reference abutting surfaces 11*e*1 and the bottom-surface wall plate 11*c* is set to be equal to the minimum thickness t2 of the signal transmission medium F or approximately has a slight gap therebetween so that the signal transmission medium F is smoothly inserted ((t3−t1)=t2). The above described step t1, in other words, the positional shift distance (height) between the reference abutting surface 11*e*1 of the edge pressing plate 11*e* and the general inner wall surface (lower surface) of the ceiling wall plate 11*b* is determined so that such a height relation is realized.

When the signal transmission medium (for example, FPC or FFC) F having the minimum thickness t2 is to be inserted to the medium insertion path having the reference abutting surfaces 11*e*1 as described above, the signal transmission medium F is inserted in a normal state in which the medium is approximately horizontally extended since the thickness t2 of the signal transmission medium F is in a state that it is equal to the opening height (t3−t1) of the medium insertion path formed by the reference abutting surfaces 11*e*1 and the bottom-surface wall plate 11*c* ((t3−t1)=t2). On the other hand, when a signal transmission medium F having a normal thickness t4 thicker than that is to be inserted, since the thickness t4 of the signal transmission medium F is larger than the opening height (t3−t1) of the medium insertion path formed by the reference abutting surfaces 11*e*1 and the bottom-surface wall plate 11*c* (t4>(t3−t1)), both-side edge parts of the signal transmission medium F are pressed downward by the abutting force of the reference abutting surfaces 11*e*1, and the both-side edge parts are deformed to form curved shapes as shown by a chain line in FIG. 16.

As described above, in the present embodiment, when the signal transmission medium F is to be inserted in the medium insertion path of the insulating housing 11, even when the thickness of the signal transmission medium F is varied, there is an arrangement relation that the first-side surface (upper surface) of the signal transmission medium F always abuts the reference abutting surfaces 11*e*1 of the edge pressing plates 11*e*.

At a connector rear edge part (right edge part in FIG. 6) of the medium insertion path, a part attachment opening 11*f* for attaching later-described electrically-conductive contacts 12 is provided so as to form a narrow long shape similarly along the connector longitudinal direction. The electrically-conductive contacts 12 to be inserted in the medium insertion path are aligned through the part attachment opening 11*f*, and the lock members 13 are disposed at the outer sides of the plurality of electrically-conductive contacts 12, in other words, respectively at the connector-longitudinal-direction both end parts of the medium insertion path.

[About Electrically-Conductive Contacts]

The electrically-conductive contacts 12 therein are formed of thin-plate-shaped metal members having appropriate shapes, the plurality of electrically-conductive contacts 12 are inserted from the part attachment opening 11*f* in the rear end side of the insulating housing 11 toward the connector front side (left side in FIG. 6), and the plurality of electrically-conductive contacts are disposed to be multipolar with appropriate intervals therebetween in the connector longitudinal direction in the insulating housing 11. Each of the electrically-conductive contacts 12 is either for signal transmission or ground connection and is used in a state in which the electrically-conductive contact is mounted by solder joint on an electrically-conductive path formed on a printed wiring board P (see FIG. 9 to FIG. 13).

More specifically, the disposing positions of the electrically-conductive contacts 12 attached to the interior of the insulating housing 11 in the above described manner are set to correspond to wiring patterns provided on the signal transmission medium (for example, FPC or FFC) F to be inserted in the insulating housing 11 through the medium insertion opening 11*a*. The wiring patterns of the signal transmission medium F are signal-transmission electrically-conductive paths (signal line pads) or shielded electrically-conductive paths (shielded line pads) disposed at appropriate pitch intervals.

The configuration of the electrically-conductive contacts 12 will be explained in detail. The electrically-conductive contacts 12 are formed so as to be extended along the connector front-back direction, which is the insertion/detachment direction (left/right direction in FIG. 6) of the signal transmission medium F. A connector-rear-end-side part of the electrically-conductive contact 12 is projecting from the connector rear end part of the insulating housing 11 to the rear side, and the rear-side projecting part is formed as a board connecting part 12*a* connected by soldering on the electrically-conductive path formed on the printed wiring board P (see FIG. 9 to FIG. 13).

Furthermore, a flexible arm part 12*b* consisting of a narrow long beam member is integrally extended from the board connecting part 12*a* of the above described electrically-conductive contact 12 toward the connector front side. The flexible arm part 12*b* is formed to be bent so as to rise approximately at right angle from the part continued to the board connecting part 12*a*, is bent again approximately at right angle from an upper end part of the rising part toward the connector front side, and is extended so as to form a cantilever shape along the inner wall surface of the ceiling wall plate 11*b* of the insulating housing 11. The flexible arm part 12*b* of the electrically-conductive contact 12 is configured to swing about the part continued to the board connecting part 12*a* or about the vicinity thereof in the top-bottom direction in the paper surface of FIG. 6.

The extended side of the flexible beam part 12*b*, in other words, the connector-front-side part (left end side part in FIG. 6) is inclined and extended toward an obliquely lower side, and the extended end part is provided with a terminal contact projecting part 12*c* corresponding to the signal-transmission electrically-conductive path or the shielded electrically-conductive path (wiring pattern) formed on the signal transmission medium (for example, FPC or FFC) F so that the terminal contact projecting part 12*c* forms a downward protruding shape in the drawing. The terminal contact projecting part 12*c* provided in the electrically-conductive contact 12 has an arrangement relation that, when the signal transmission medium F is inserted in the medium insertion path of the insulating housing 11 in the above described manner, the terminal contact projecting part 12*c* is placed over the wiring pattern of the signal transmission medium F; and, when the signal transmission medium F is inserted to a final position, both of them are brought into contact with a pressure by the elastic force of the flexible beam part 12*b*, and an electrically connected state is maintained.

[About One-Action Auto-Lock Mechanism]

Figure 1:
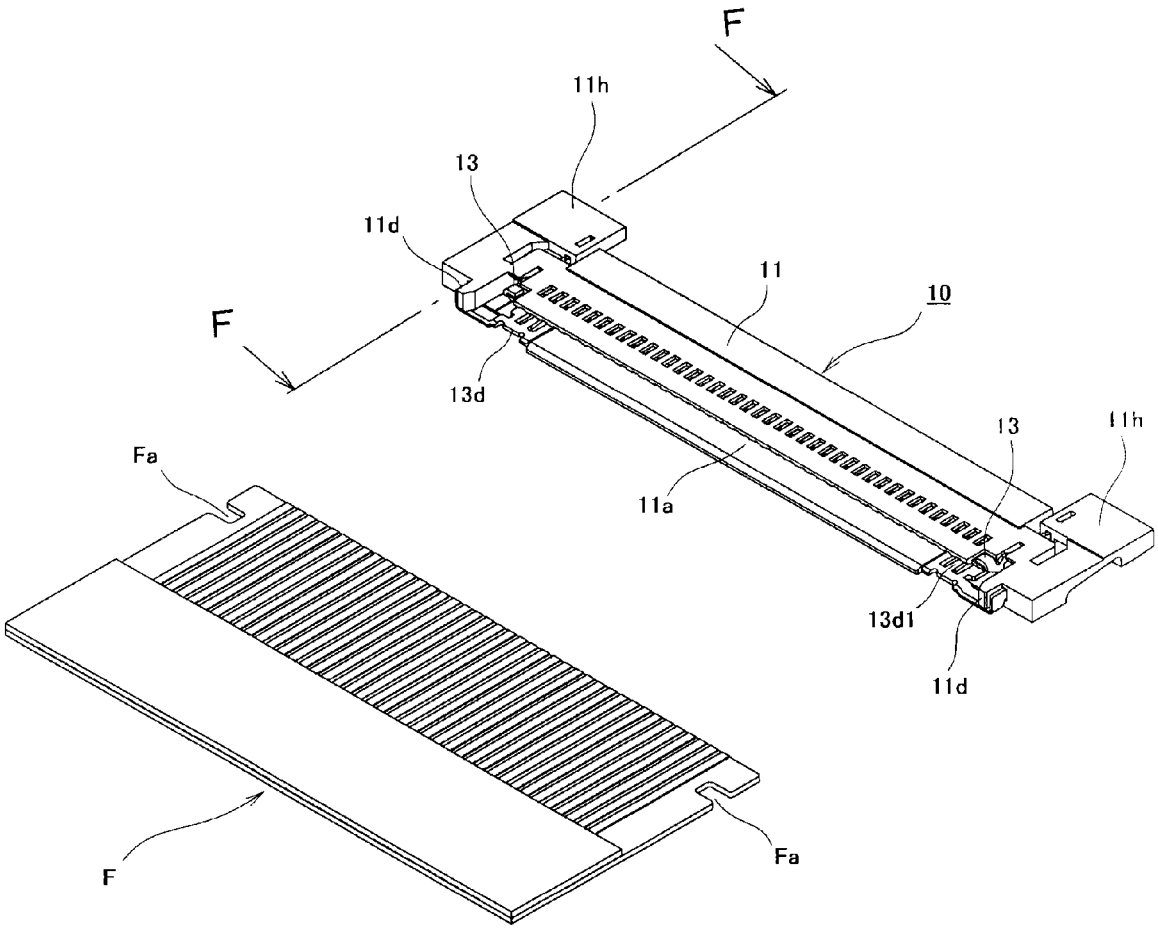
FIG. 1 is an explanatory external perspective view showing a state immediately before a signal transmission medium (FPC) is inserted in an electrical connector according to an embodiment of the present invention.
Figure 2:
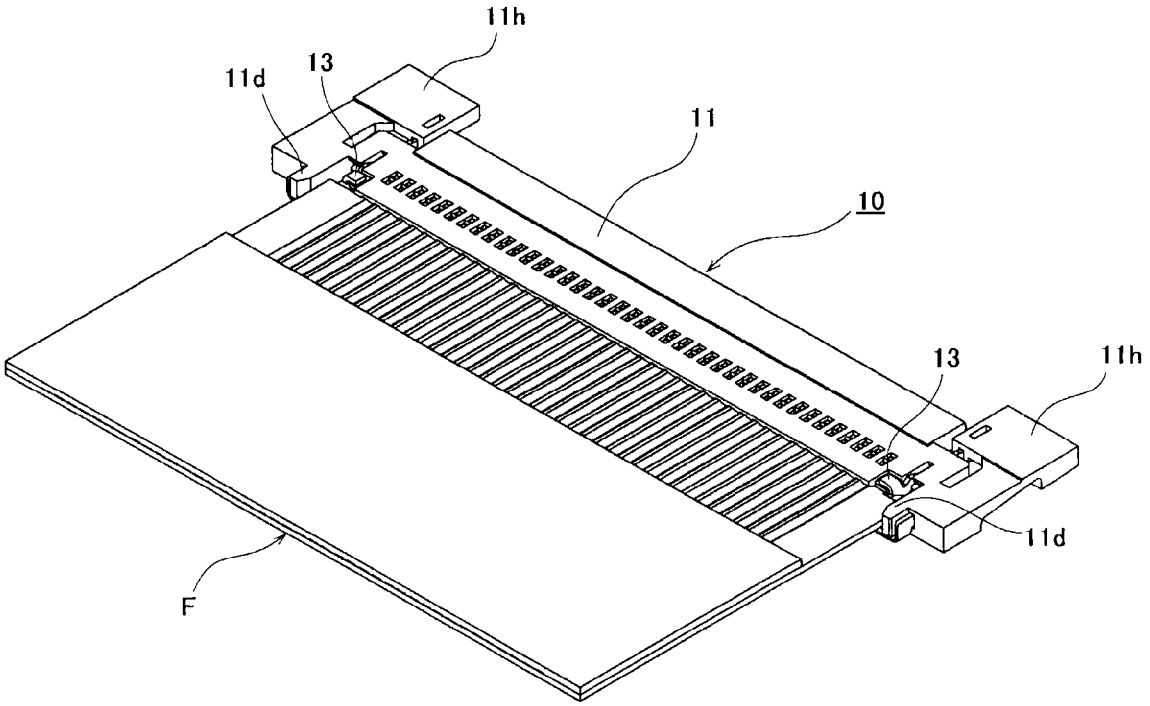
FIG. 2 is an explanatory external perspective view showing a state in which the signal transmission medium is latched by latch lock parts after the signal transmission medium (FPC) has been inserted from the state shown in FIG. 1 to complete insertion of the signal transmission medium with respect to the electrical connector.
Figure 3:
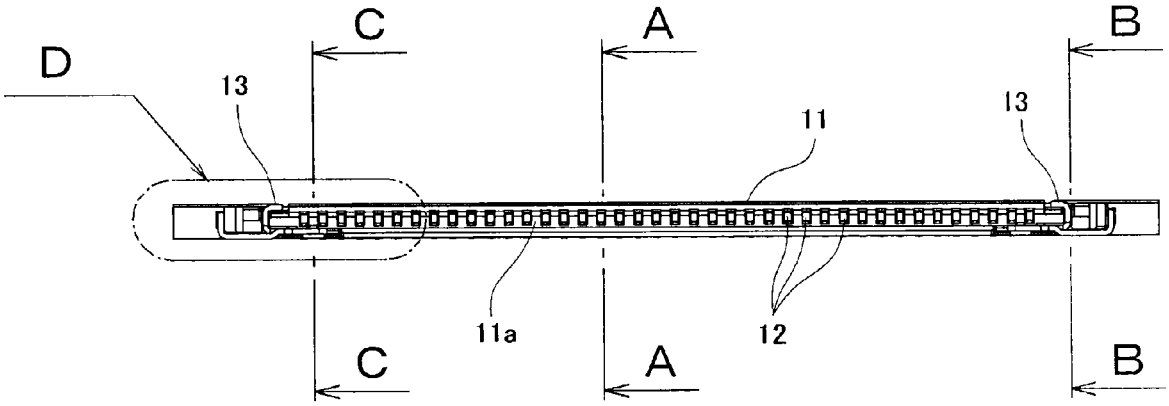
FIG. 3 is an explanatory front view of the electrical connector shown in FIG. 1 and FIG. 2.
Figure 4:
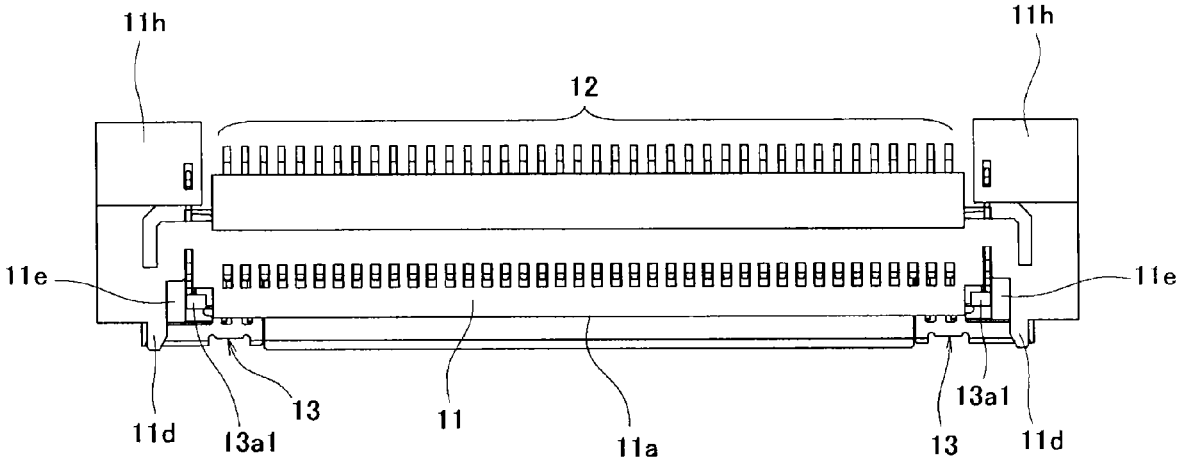
FIG. 4 is an explanatory plan view of the electrical connector shown in FIG. 1 and FIG. 2.
Figure 5:
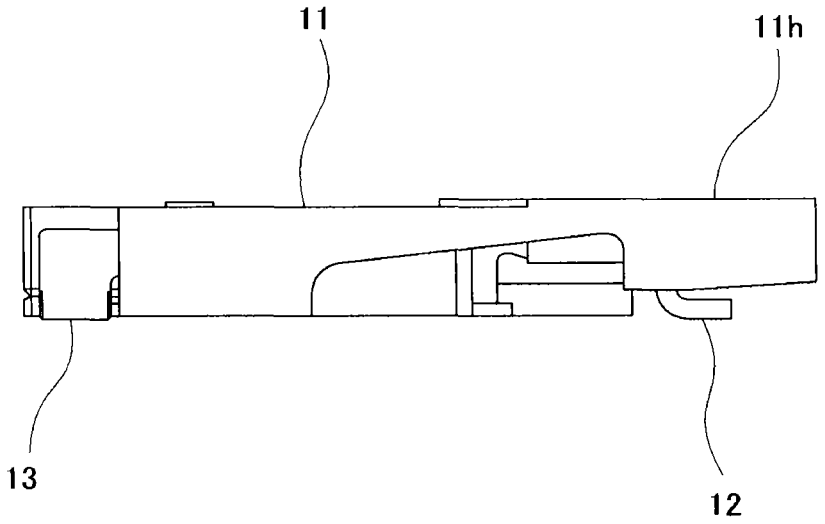
FIG. 5 is an explanatory lateral view of the electrical connector shown in FIG. 1 and FIG. 2.

The electrical connector 10 according to the present embodiment is provided with the one-action auto-lock mechanism as described above. As a condition therefor, in the terminal part of the signal transmission medium (for example, FPC or FFC) F, particularly as shown in FIG. 1, engagement position determining parts Fa, Fa consisting of cut-away recessed parts are formed at width-direction both-side edge parts. Corresponding to the engagement position determining parts Fa, Fa provided in the signal transmission medium F, the lock members 13, 13 are provided in the electrical connector 10 side, and the inserted state of the signal transmission medium F is configured to be retained by the latching action (lock action) of the lock members 13, 13.

[About Lock Members]

As described above, the pair of lock members 13, 13 disposed in the connector-longitudinal-direction both-side parts of the insulating housing 11 as described above have mutually symmetrical structures in the connector longitudinal direction. Therefore, explanation hereinafter will be given only about one of the lock members 13, and the other will be omitted.

The lock member 13 constitutes a lock mechanism and an unlock mechanism for the signal transmission medium (for example, FPC or FFC) F and is disposed in the vicinity of the guide side wall plates 11*d*, 11*d* forming one of the connector-longitudinal-direction both-side wall surfaces of the medium insertion path of the above described insulating housing 11. More specifically, a latch lock part 13*a* provided at a distal end part of the lock member 13 as described later is disposed at a position adjacent to the connector inner side (connector center side) with respect to the edge pressing plate 11*e* coupled to the guide side wall plate 11*d*.

Figure 10:
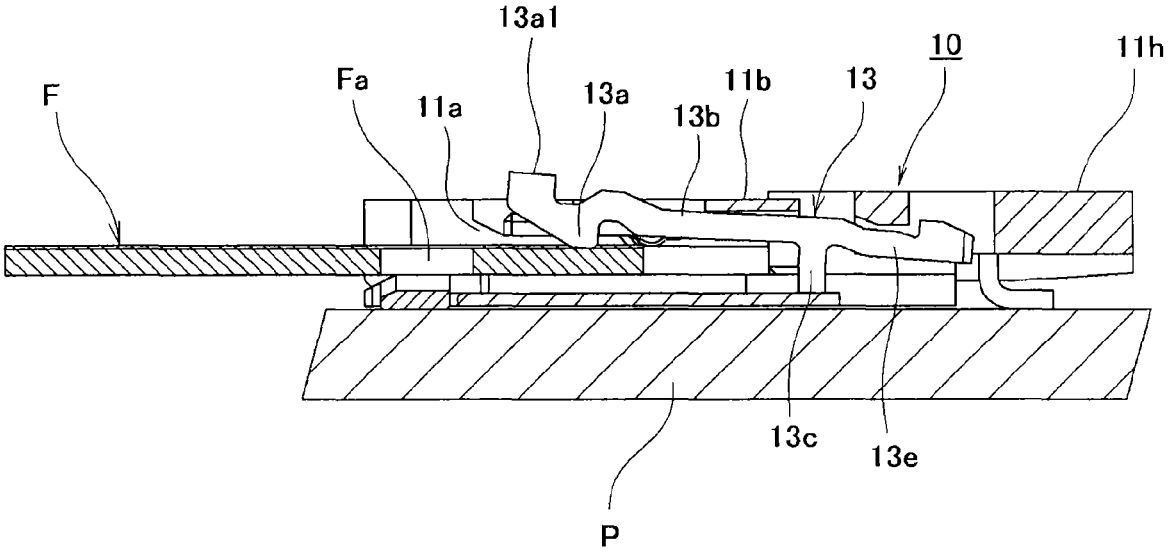
FIG. 10 is an explanatory transverse cross-sectional view corresponding to FIG. 7 showing the state in which the signal transmission medium (FPC) has been inserted to carry out insertion of the signal transmission medium with respect to the electrical connector to an intermediate level.

When the signal transmission medium F is inserted in the electrical connector 10, the insertion-side distal-edge of the signal transmission medium F abuts part of the lock member 13, more specifically, the later-described latch lock part 13*a*, thereby achieving a state in which the latch lock part 13*a* is elastically displaced so as to be placed over the surface of the signal transmission medium F (see FIG. 10). Furthermore, along with insertion of the signal transmission medium F, the latch lock part 13*a* is configured to be dropped in the engagement position determining part Fa of the signal transmission medium F to achieve an engaged state (locked state) (see FIG. 11).

Figure 14:
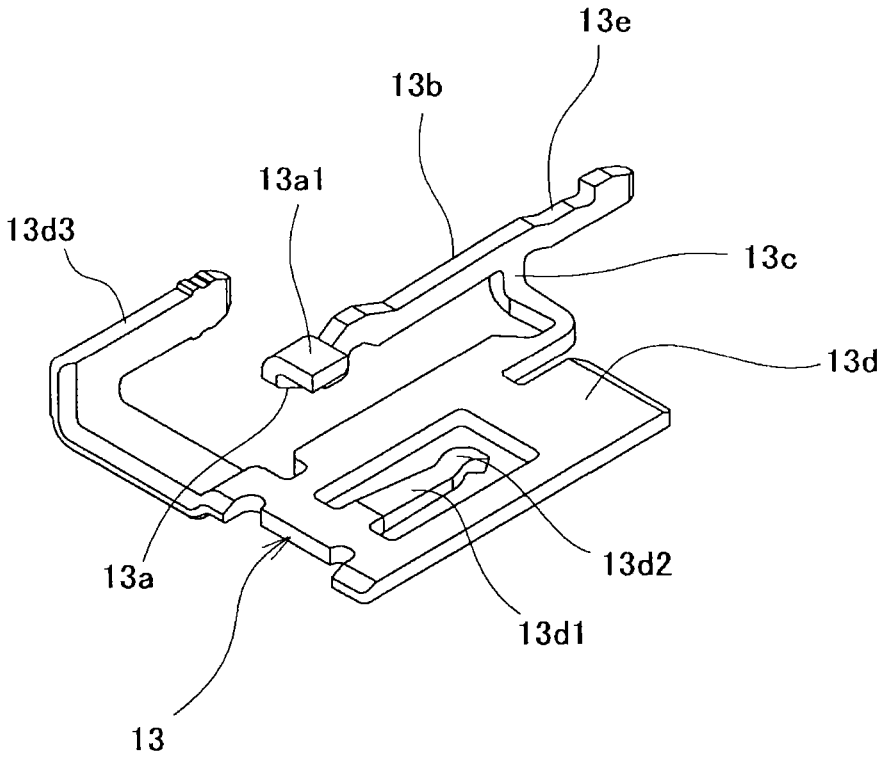
FIG. 14 is an explanatory external perspective view showing the structure of a lock member used in the electrical connector shown in FIG. 1 to FIG. 13.
Figure 15:
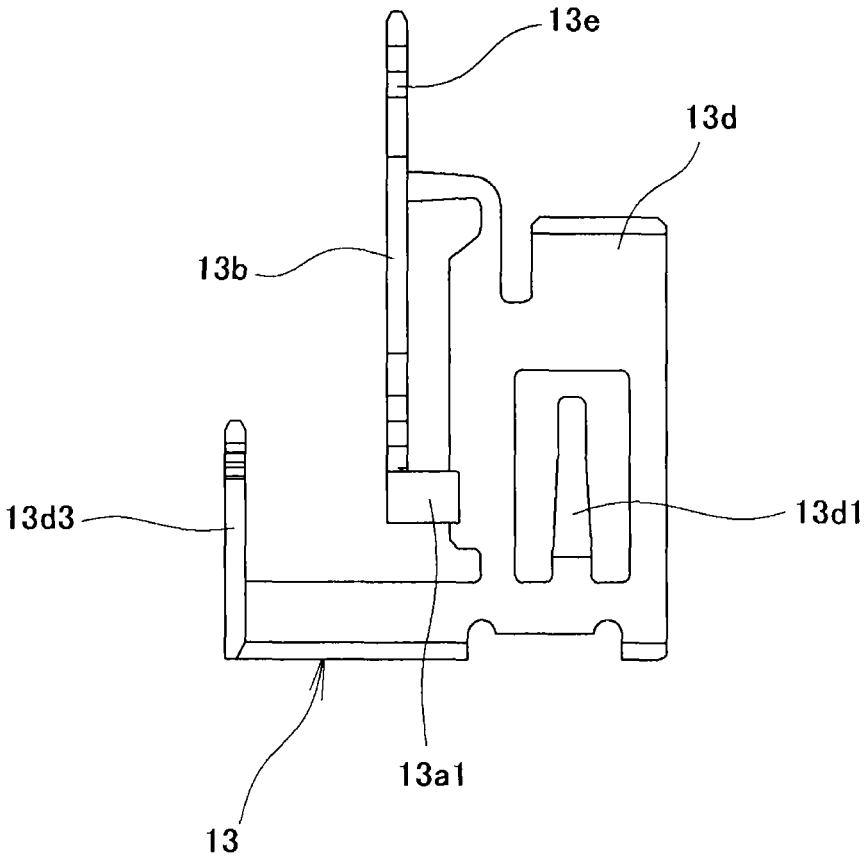
FIG. 15 is an explanatory plan view showing the structure of the lock member shown in FIG. 14.

Particularly as shown in FIG. 14 and FIG. 15, the entirety of the lock member 13 of this case is formed of an integrated bent structure consisting of a thin-plate-like metal member, and a movable beam part 13*b* consisting of a narrow long beam member having the above described latch lock part 13*a* is integrally continued to a fixed board 13*d* via a coupling pillar part 13*c*. The fixed board 13*d* therein is formed of a plate-like member having an approximately rectangular shape in a plane and is disposed so as to be placed on the upper surface of the bottom-surface wall plate 11*c* of the medium insertion path of the above described insulating housing 11.

In an approximately center region of the fixed board 13*d*, a pressing member 13*d*1 consisting of a spring-like member is integrally formed with the fixed board 13*d*. The pressing member 13*d*1 is formed of a plate spring piece extended so as to form a cantilever shape toward the connector rear side, and, in an extended-side distal end part thereof, a contact-point projecting part 13*d*2 to be connected to a ground electrically-conductive path of the signal transmission medium (for example, FPC or FFC) F is formed so as to project to the upper side.

When the contact-point projecting part 13*d*2 provided in the pressing member 13*d*1 is brought into contact upward with the lower surface of the signal transmission medium F from the lower side, the signal transmission medium F is configured to be pushed up toward the upper side in the thickness direction thereof by the elastic biasing force of the pressing member 13*d*1. In this case, the pressing member 13*d*1 is disposed so as to be opposed to the later-described latch lock part 13*a* in the vertical direction, and the signal transmission medium F is configured to be pushed toward the latch lock part 13*a* side by the elastic biasing force of the pressing member 13*d*1.

The supporting piece 13*d*3 bulging toward the connector outer side is integrally continued to a connector front edge part of the above described fixed board 13*d*. The supporting piece 13*d*3 is extended approximately horizontally from the outer-side edge part of the fixed board 13*d* toward the connector-longitudinal-direction outer side via a downward step, then rises so as to be bent approximately at right angle toward the connector upper side, is further bent at approximately right angle from the upper end part thereof toward the connector rear side, and is extended approximately horizontally. The supporting piece 13*d*3 of this case is press-fitted in a wall part of the insulating housing 11 in the connector-longitudinal-direction outer side with respect to the above described medium insertion opening 11*a*, and the entire lock member 13 is fixed to the insulating housing 11 by the fixing force caused by press-fit of the supporting piece 13*d*3.

The supporting piece 13*d*3 provided in the lock member 13 is disposed so as to be adjacent to the connector outer side of the guide side wall plates 11*d*, 11*d* of the insulating housing 11, which forms one of the connector-longitudinal-direction both-side wall surfaces of the medium insertion path as described above; and the supporting piece 13*d*3 is disposed so as to form a reinforcing member from the connector outer side for the guide side wall plate 11*d*, which is formed of a comparatively-thin plate-like member.

Furthermore, the above described coupling pillar part 13*c* is integrally continued to the connector rear edge part of the fixed board 13*d*. The coupling pillar part 13*c* is formed of a narrow plate-like member, is extended approximately horizontally toward the connector rear side, then is bent at approximately right angle and extended toward the connector-longitudinal-direction outer side, and further rises from the outer end part thereof toward the upper side so as to be bent approximately at right angle. The above described movable beam part 13*b* is coupled to the upper end part of the coupling pillar part 13*c* so as to be approximately horizontally extended.

In the medium insertion path of the insulating housing 11, the movable beam part 13*b* is extended in the connector front-back direction from the bottom-surface wall part 11*c* of the medium insertion path with an appropriate gap in the upper side and is extended so as to be branched into two opposite directions of the connector front side and the connector rear side from the part coupled to the above described coupling pillar part 13*c*. Based on the elastic flexibility of the coupling pillar part 13*c*, the movable beam part 13*b* is elastically displaceable, and the movable beam part 13*b* is configured to be swingable while using the coupling pillar part 13*c* or the vicinity thereof as a turning center. The swinging of the movable beam part 13*b* in this case is carried out in the top-bottom direction in the paper surface of FIG. 6.

The latch lock part 13*a* consisting of a hook-like member is provided at the front-end-side part (left-end-side part in FIG. 10) of the movable beam part 13*b*, which is formed as a swinging member as described above. The latch lock part 13*a* is formed of a plate-like member projecting downward approximately in the shape of a triangle, a vertex part is provided in the lower end side of the latch lock part 13*a*, and an inclined guiding side extended obliquely from the lower-end-side vertex part toward the front-side upper side is provided. When the latch lock part 13*a* having such a configuration is disposed at a position immediately above the engagement position determining part Fa provided at the terminal part of the signal transmission medium F, the latch lock part 13*a* drops to the interior of the engagement position determining part Fa to obtain a latched state, and the inserted state of the signal transmission medium F is configured to be retained by the engaging force of the latch lock part 13*a* caused at this point.

Figure 11:
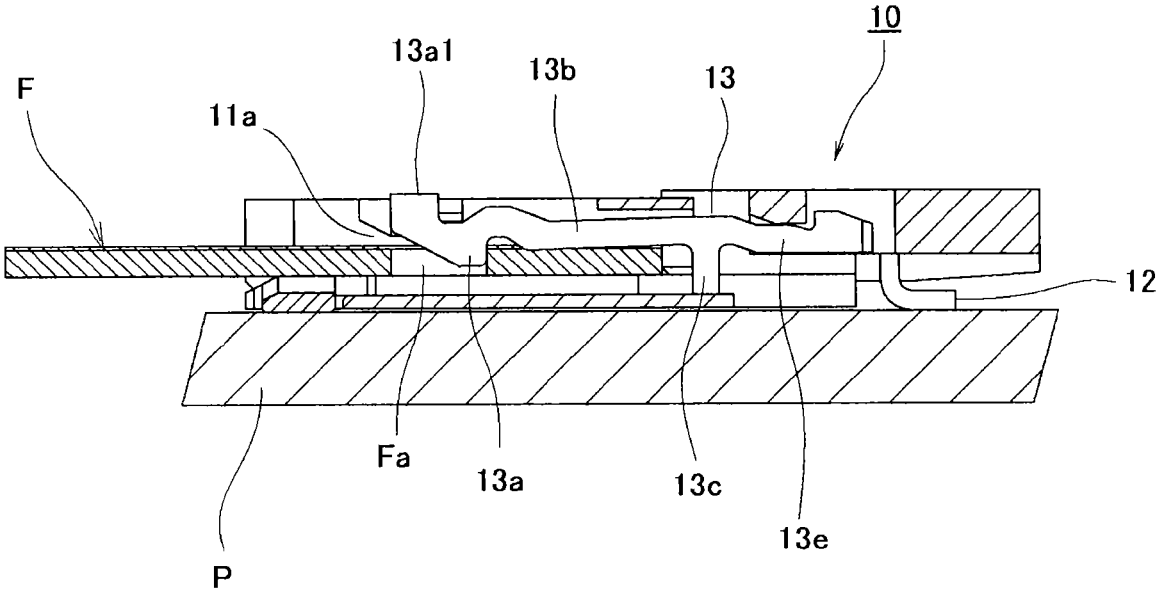
FIG. 11 is an explanatory transverse cross-sectional view corresponding to FIG. 7 showing a locked state in which the signal transmission medium (FPC) has been inserted to complete insertion of the signal transmission medium with respect to the electrical connector.

Herein, the state from insertion to engagement of the signal transmission medium (for example, FPC or FFC) F will be explained in detail. First, as shown in FIG. 10, when insertion is carried out so that the signal transmission medium F is inserted in the medium insertion path of the insulating housing 11 through the medium insertion opening 11*a* of the insulating housing 11, the insertion-side distal-edge part of the signal transmission medium F abuts the inclined guiding side of the latch lock part 13*a* provided in the lock member 13, the upward component force generated at the inclined guiding side causes the latch lock part 13*a* to be placed on the surface of the signal transmission medium F. As a result, the movable beam part 13*b* of the above described lock member 13 is elastically displaced so as to be pushed to the upper side about a swing supporting point in the vicinity of the coupling pillar part 13*c* as shown in FIG. 10. Furthermore, when the terminal part of the signal transmission medium F is pushed in toward the connector rear side, at the point when the engagement position determining part Fa of the signal transmission medium F is moved to the position immediately below the latch lock part 13*a*, as shown in FIG. 11, the elastic recovery force of the movable beam part 13*b* causes the latch lock part 13*a* to swing so that the latch lock part 13*a* drops to the interior of the engagement position determining part Fa of the signal transmission medium F. As a result, the latch lock part 13*a* is latched and obtains an engaged state with respect to the engagement position determining part Fa of the signal transmission medium F, and the signal transmission medium F is retained so that the medium does not fall off to the connector front side.

When the signal transmission medium (for example, FPC or FFC) F is caused to be in the engaged state (locked state) by the lock member 13 in this manner, the connector front-side part of the movable beam part 13*b* including the above described latch lock part 13*a* is elastically displaced so as to be pushed upward; wherein the elastic displacement of the movable beam part 13*b* to the upper side in this process is allowed by a slit part formed in the ceiling wall plate 11*b* of the insulating housing 11, which forms the upper wall surface of the medium insertion path. The slit part is formed of a narrow long hole part penetrating through the ceiling wall plate 11*b* of the insulating housing 11, has a length that includes the part from the coupling pillar part 13*c* to the latch lock part 13*a* in the upper-side part of the above described movable beam part 13*b*, and is formed of a narrow long space part having a gap slightly larger than the plate thickness of the movable beam part 13*b*.

Then, when the signal transmission medium (for example, FPC or FFC) F is inserted to the interior of the insulating housing 1 in the above described manner, the latch lock part 13*a* of the lock member 13 is placed over the surface of the signal transmission medium F, thereby elastically displacing the movable beam part 13*b* of the lock member 13 so that the movable beam part is pushed to the upper side; and it is configured that, as a result, the front-side part of the movable beam part 13*b*, which has been elastically displaced upward, enters the interior of the above described slit part serving as a lock checking means, the upward elastic displacement of the movable beam part 13*b* is therefore allowed, and the upward elastic displacement of the movable beam part 13*b* is visually checked.

The stopper piece 13*a*1 is extended from the upper edge part of the above described latch lock part 13*a* toward the connector-longitudinal-direction inner side (connector center side) so as to form a flange shape. The stopper piece 13*a*1 forming the flange shape is disposed so as to face the upper side of a support receiving part 11*g*, which is formed so as to dent an upper surface part of the insulating housing 11. When the latch lock part 13*a* is engaged with the engagement position determining part Fa of the signal transmission medium (for example, FPC or FFC) F in the above described manner, the stopper piece 13*a*1 abuts the support receiving part 11*g* of the insulating housing 11 so that the lower-side movement position of the stopper piece 13*a*1 is regulated to a constant position.

[About Unlock Mechanism]

Figure 12:
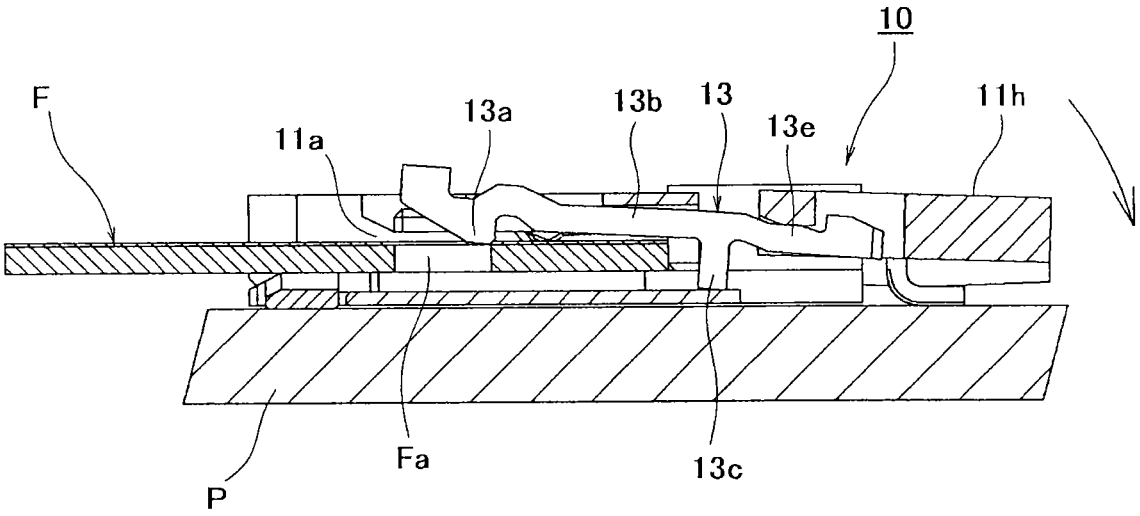
FIG. 12 is an explanatory transverse cross-sectional view corresponding to FIG. 7 showing a state in which an unlocking operation has been carried out from a locked state of the signal transmission medium (FPC)
Figure 13:
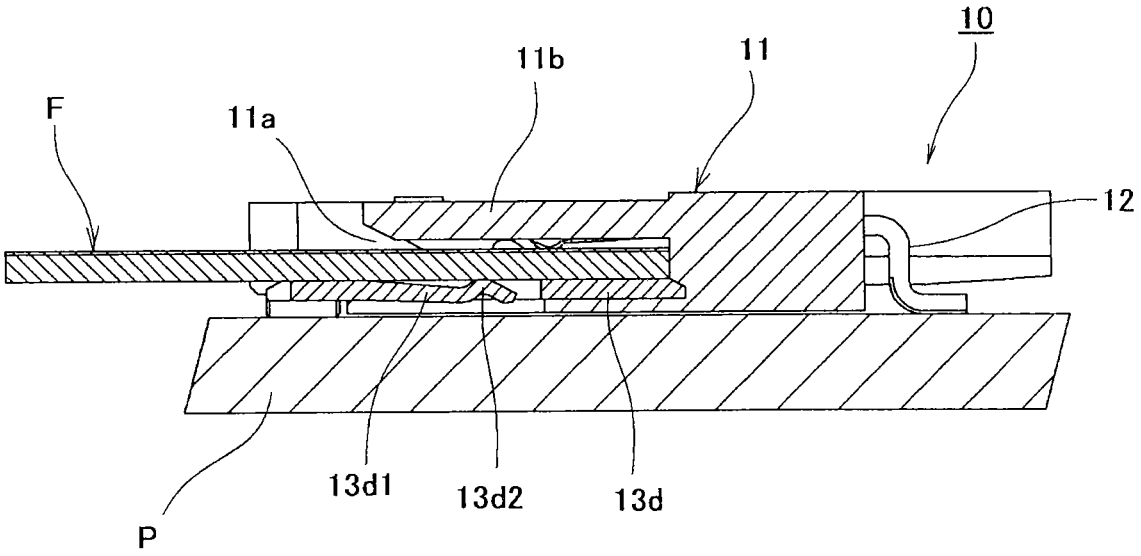
FIG. 13 is an explanatory transverse cross-sectional view corresponding to FIG. 8 showing the state in which the signal transmission medium (FPC) has been inserted to complete insertion of the signal transmission medium with respect to the electrical connector.

On the other hand, when an unlocking operation is carried out as shown in FIG. 12 in the state in which the latch lock part 13*a* is engaged with the engagement position determining part Fa of the signal transmission medium F to retain the signal transmission medium F in the above described manner, the latch lock part 13*a* is swung so as to be lifted up to the upper side against the elastic force of the movable beam part 13*b* of the lock member 13, and the latch lock part 13*a* is detached from the engagement position determining part Fa of the signal transmission medium F.

More specifically, in the movable beam part 13*b* of the above described lock member 13, an unlocking pressing part 13*e* is provided at a part in the opposite side of the latch lock part 13*a*, in other words, at a beam-like part extended from the coupling pillar part 13*c* to the rear side. The unlocking pressing part 13*e* is configured to be swung in the opposite direction of the above described latch lock part 13*a* and is formed so as to be projected from the rear end part of the insulating housing 11 toward the rear-side outer side. When the unlocking pressing part 13*e* is pushed to the lower side, the latch lock part 13*a* in the front end side is configured to be pushed to the upper side.

Corresponding to the unlocking pressing parts 13*e* like this, a pair of lock-operation cover parts 11*h*, 11*h* are provided at connector-longitudinal-direction both-end parts of the rear end part of the insulating housing 11. Each of the lock-operation cover parts 11*h* is extended from the rear end part of the insulating housing 11 toward the rear side so as to form a cantilever shape at a position immediately above the unlocking pressing part 13*e* of the above described lock member 13 and is in an arrangement relation that the lock-operation cover part 11*h* is overlapped with the unlocking pressing part 13*e* from the upper side. Each of the lock-operation cover part 11*h* is formed of a plate-like member formed to be comparatively wide, and the lock-operation cover part 11*h* formed to be comparatively wide is in an arrangement relation so as to cover the upper edge part of the unlocking pressing part 13*e* having a narrow plate thickness from the upper side.

A bumpy anti-slip part is formed on the upper surface of the lock-operation cover part 11*h* like this. When the lock-operation cover part 11*h* is pressed down to the lower side by, for example, a fingertip of an operator, the unlocking pressing part 13*e* of the above described lock member 13 is similarly pressed down to the lower side, and the latch lock part 13*a* provided in the opposite side of the movable beam part 13*b* is therefore pushed up to the upper side. As a result, the latch lock part 13*a*, which has been engaged with the engagement position determining part Fa of the signal transmission medium F, is moved to the upper side from the engagement position determining part Fa, and the signal transmission medium F becomes a free state and a state in which it can be removed toward the front side.

When the lock member 13 is subjected to an unlocking operation in this manner, the front-side part of the movable beam part 13*b* including the latch lock part 13*a* is elastically displaced so as to be pushed up to the upper side as described above; wherein, the upper-side elastic displacement of the movable beam part 13*b* in this process is allowed by the slit part provided in the insulating housing 11 as well as the insertion of the above described signal transmission medium (for example, FPC or FFC) F, and the upper-side projecting part of the movable beam part 13*b* is configured to project to the upper side through the slit part. When the upper-side projecting part of the movable beam part 13*b* is visually checked from outside, the displacement state of the lock member 13 can be easily checked.

According to the present embodiment having such a configuration, when the signal transmission medium (for example, FPC or FFC) F is inserted so as to be inserted in the medium insertion path of the insulating housing 11, the reference abutting surface 11*e*1 forming part of the inner wall surface of the medium insertion path formed of the ceiling wall plate 11*b* of the insulating housing 11 is in a positional relation that the reference abutting surface 11*e*1 is close to the first-side surface (upper surface) of the signal transmission medium F than the other part (connector center-side region) is. Therefore, the first-side surface (upper surface) of the signal transmission medium F is inserted in a state in which the first-side surface is abutting at least the reference abutting surface 11*e*1 of the medium insertion path, and the first-side surface (upper surface) of the signal transmission medium F is caused to be in a state that the position thereof is determined in the thickness direction (height direction) while using the reference abutting surface 11*e*1 as a reference.

On the other hand, the latch lock part 13*a* is moved to the lower side from the state, in which the latch lock part 13*a* is in contact with the first-side surface (upper surface) of the signal transmission medium F from the upper side, and is moved to the engagement position. Therefore, since the position of the first-side surface (upper surface) of the signal transmission medium F is determined by the reference abutting surface 11*e*1 in the above described manner, the engagement amount (latch amount) of the latch lock part 13*a* with respect to the engagement position determining part Fa of the signal transmission medium F is constantly maintained regardless of variations in the thickness of the signal transmission medium F. As a result, the force of retaining the signal transmission medium F by the latch lock part 13*a* is stabilized, the movement distance of the latch lock part 13*a* necessary for canceling the engaged state of the latch lock part 13*a* becomes constant, and the entire electrical connector 10 can be downsized without taking variations in the thickness of the signal transmission medium F into consideration.

Particularly, in the present embodiment, the lower-side movement position of the latch lock part 13*a* is regulated to a constant position by the stopper piece 13*a*1; therefore, a further stable engagement amount of the latch lock part 13*a* with respect to the signal transmission medium (for example, FPC or FFC) F is obtained. Furthermore, in the present embodiment, the signal transmission medium F inserted in the medium insertion path is pressed toward the latch lock part 13*a* side, in other words, toward the upper side by the pressing member 13*d*1 provided in the lock member 13; therefore, pressing of the signal transmission medium F against the reference abutting surface 11*e*1 constituting the lower surface of the edge pressing plate 11*e* is more reliably carried out.

Moreover, according to the present embodiment, the signal transmission medium (for example, FPC or FFC) F inserted in the medium insertion path is smoothly moved along the guide side wall plate 11*d* of the insulating housing 11, and the guide side wall plate 11*d* of the insulating housing 11 is reinforced by the supporting piece 13*d*3 continued to the latch lock part 13*a*. Therefore, the thickness of the guide side wall plate 11*d* can be reduced, and the entirety of the electrical connector 10 can be correspondingly downsized.

Hereinabove, the invention accomplished by the present inventor has been explained in detail based on the embodiment. However, the present invention is not limited to the above described embodiment, and it goes without saying that various modifications can be made within a range not departing from the gist thereof.

For example, the electrical connector according to the above described embodiment is configured so that the reference abutting surface abuts the upper surface side of the signal transmission medium. However, in the structure in which the latch lock part is moved from a position opposed to the lower surface side of the signal transmission medium toward the upper side to carry out engagement, the reference abutting surface is configured to abut the lower surface side of the signal transmission medium.

The electrical connector according to the above described embodiment is an electrical connector of a so-called NON-ZIF type in which a contact member undergoes slight contact when a signal transmission medium is inserted. However, the present invention can be similarly applied to an electrical connector of a so-called ZIF type in which a contact member is in a state separated from a signal transmission medium when the signal transmission medium is inserted.

Furthermore, in the above described embodiment, as the signal transmission media to be fixed to the electrical connector, a flexible printed circuit (FPC) and a flexible flat cable (FFC) are employed. However, the present invention can be similarly applied also to a case in which other signal transmission media are employed.

Furthermore, the electrically-conductive contacts having the same shape are used in the electrical connector according to the above described embodiment. However, the present invention can be similarly applied also to a structure in which electrically-conductive contacts having different shapes are alternately disposed.

The present invention can be widely applied to various electrical connectors used in various electric devices.

What is claimed is:

1. An electrical connector configured so that a signal transmission medium comes to be inserted to or removed from an interior space between an upper-side inner wall surface and a lower-side inner wall surface of a medium insertion path formed so as to be surrounded by an inner wall surface of an insulating housing, and configured so that, when a latch lock part(s) is moved to an engagement position with respect to an engagement position determining part of the signal transmission medium inserted in the medium insertion path, the latch lock part retains the signal transmission medium; wherein part of the upper-side inner wall surface of the medium insertion path facing a first-side surface of the signal transmission medium is provided with a reference abutting surface that abuts the upper first-side surface of the signal transmission medium, and the reference abutting surface is formed so as to form a stepped shape projecting toward the upper first-side surface of the signal transmission medium compared with other part of the upper-side inner wall surface of the medium insertion path facing the upper first-side surface of the signal transmission medium, the latch lock part is in an arrangement relating that the latch lock part is placed over an upper-side surface of the signal transmission medium and elastically displaced, the reference abutting surface is formed at part of the upper-side inner wall surface of the medium insertion path facing the upper-side surface of the signal transmission medium, and the reference abutting surface is positioned in a lower side with respect to the other part of upper-side inner wall surface so as to form the stepped shape.

2. The electrical connector according to claim 1, wherein the latch lock parts are disposed in connector longitudinal-direction both-side regions of the signal transmission medium, and the reference abutting surface is disposed at a position adjacent to the latch lock part in the connector longitudinal direction.

3. The electrical connector according to claim 1, wherein the latch lock part is provided with a stopper piece that abuts part of the insulating housing when engaged with the engagement position determining part of the signal transmission medium.

4. The electrical connector according to claim 1, wherein the latch lock part is integrally continued to a pressing member opposed to the latch lock part in a thickness direction of the signal transmission medium, and the signal transmission medium is configured to be biased toward the latch lock part side by the pressing member.

5. The electrical connector according to claim 4, wherein the pressing member has a cantilever-like plate spring piece connected to a ground electrically-conductive path of the signal transmission medium.

6. The electrical connector according to claim 1, wherein the insulating housing is provided with guide side wall plates to be brought into contact with connector longitudinal direction both-side surfaces of the signal transmission medium inserted in the medium insertion path, and a supporting piece part that abuts each of the guide side wall plates of the insulating housing of the signal transmission medium is integrally formed with the latch lock part.

* * * * *